US012351387B2

(12) United States Patent
Limbaugh

(10) Patent No.: US 12,351,387 B2
(45) Date of Patent: Jul. 8, 2025

(54) ANCHORING APPARATUS FOR BURIED OBJECTS

(71) Applicant: Brad Limbaugh, Sandpoint, ID (US)

(72) Inventor: Brad Limbaugh, Sandpoint, ID (US)

( * ) Notice: Subject to any disclaimer, the term of this patent is extended or adjusted under 35 U.S.C. 154(b) by 69 days.

(21) Appl. No.: 18/383,986

(22) Filed: Oct. 26, 2023

(65) Prior Publication Data

US 2025/0136359 A1 May 1, 2025

(51) Int. Cl.

| | |
|---|---|
| ***B65D 90/12*** | (2006.01) |
| *B65D 88/76* | (2006.01) |
| *B65D 88/78* | (2006.01) |

(52) U.S. Cl.

CPC ..... *B65D 90/12* (2013.01); *B65D 88/76* (2013.01); *B65D 88/78* (2013.01)

(58) Field of Classification Search

CPC ..... B65D 90/12; B65D 88/76; B65D 88/78; E04B 1/02

USPC ..... 220/484, 567.1, 636, 23.4

See application file for complete search history.

(56) References Cited

U.S. PATENT DOCUMENTS

| | | | | |
|---|---|---|---|---|
| 5,361,930 | A | 11/1994 | Perry | |
| 5,884,580 | A * | 3/1999 | Faircloth, Jr. | A01K 1/035 119/51.5 |
| 5,927,898 | A * | 7/1999 | Gavin | E03F 11/00 220/636 |
| 6,141,918 | A * | 11/2000 | Wrightson | E02D 31/12 52/166 |
| 6,345,933 | B1 | 2/2002 | Harding | |
| 8,814,120 | B1 * | 8/2014 | Kleespie | B65D 90/12 248/677 |
| D736,835 | S | 8/2015 | Pasco | |
| 9,151,073 | B2 | 10/2015 | Watson | |
| 10,507,953 | B1 * | 12/2019 | Worsham | B65D 1/0207 |
| 10,533,701 | B2 | 1/2020 | Dufresne | |
| 2006/0260993 | A1 * | 11/2006 | Daley | E03F 5/02 220/4.12 |
| 2015/0184803 | A1 * | 7/2015 | Jarzynski | B60K 15/07 220/4.01 |
| 2016/0083054 | A1 * | 3/2016 | Valtanen | B65D 90/48 701/21 |

* cited by examiner

*Primary Examiner* — Stephen J Castellano

(57) ABSTRACT

An anchoring apparatus for anchoring objects underground against upward forces includes a pair of bases, each of which comprises a container for holding weights. The object to be anchored may be positioned over the pair of bases such that the bases extend outwardly from the object. The bases are attachable to the load via mounting straps, threaded fasteners, or the like. The bases push against soil when upward forces act on the object, and the weights further operate to secure the object against the upward force.

9 Claims, 7 Drawing Sheets

ANCHORING APPARATUS FOR BURIED OBJECTS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to anchoring apparatuses and more particularly pertains to a new anchoring apparatus for anchoring a load in response to upward forces.

(2) Description of Related Art Including Information Disclosed Under 37 CFR 1.97 and 1.98

Buried vessels which are buoyant in water face the problem of experiencing conditions which cause the buried vessels to rise out of the ground, such as when the water table rises or when a flood causes water to invade the immediate surroundings of the buried vessels. The prior art describes various anchoring apparatuses for anchoring objects in the ground to overcome this issue. However, the prior art fails to describe such an apparatus which comprises containers for holding weights such as water, sand, rocks, or the like.

BRIEF SUMMARY OF THE INVENTION

An embodiment of the disclosure meets the needs presented above by generally comprising a pair of bases, each of which comprises a container which defines an interior space. The container has a bottom wall, a perimeter wall, and a top wall. The perimeter wall is coupled to and extends between the bottom wall and the top wall. The top wall has a support portion which is configured to support a load. The top wall also has an outer portion and a medial portion. The medial portion is coupled to and extends between the outer portion and the support portion. The outer portion defines a fill hole which is in fluid communication with the interior space. The bases are positionable with respect to each other such that the support portions of the bases are positioned adjacent to each other. The pair of bases are securable via mounting straps, weldments, threaded fasteners, or the like to the load.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
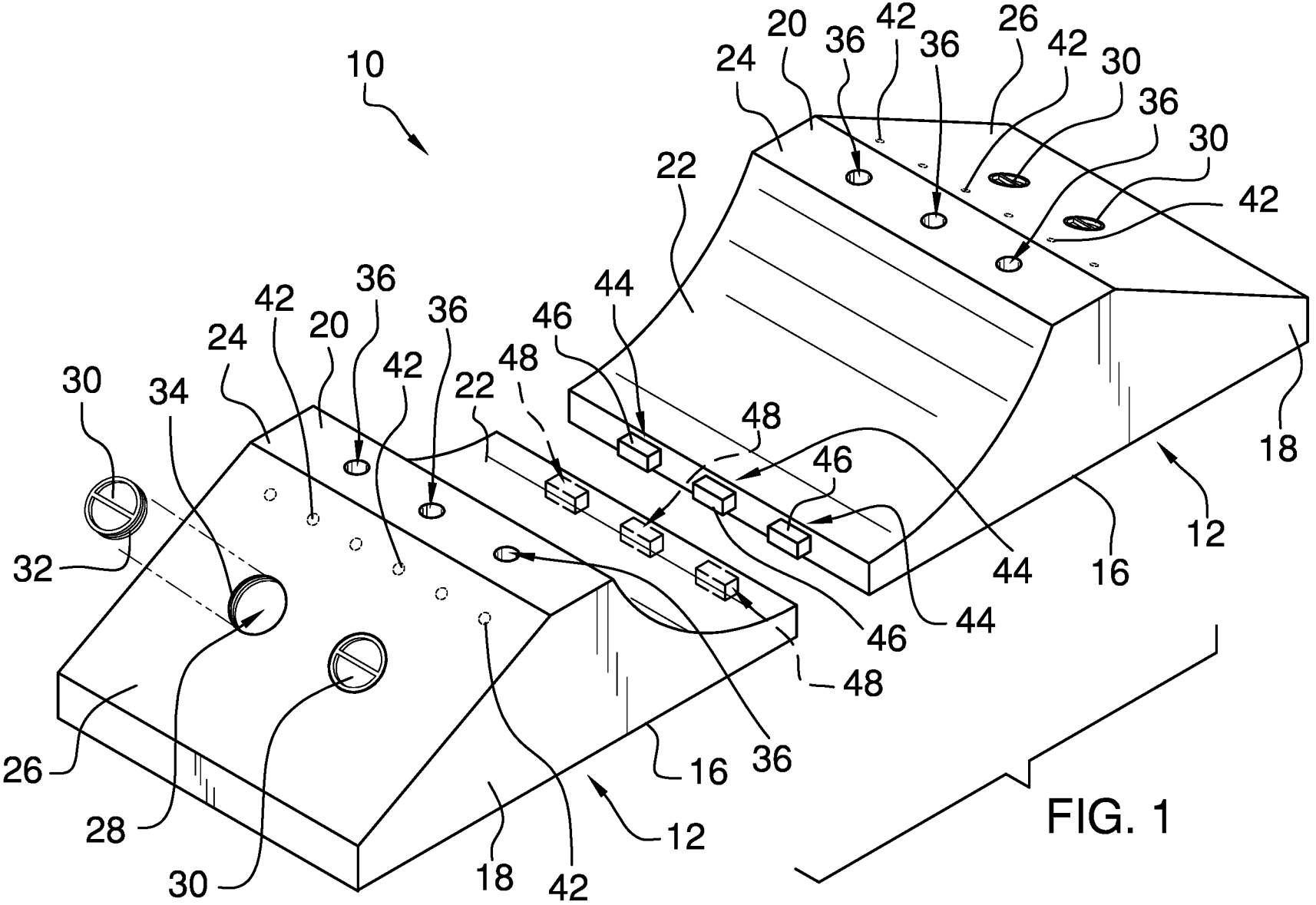
FIG. 1 is a perspective exploded view of an anchoring apparatus according to an embodiment of the disclosure.
Figure 2:
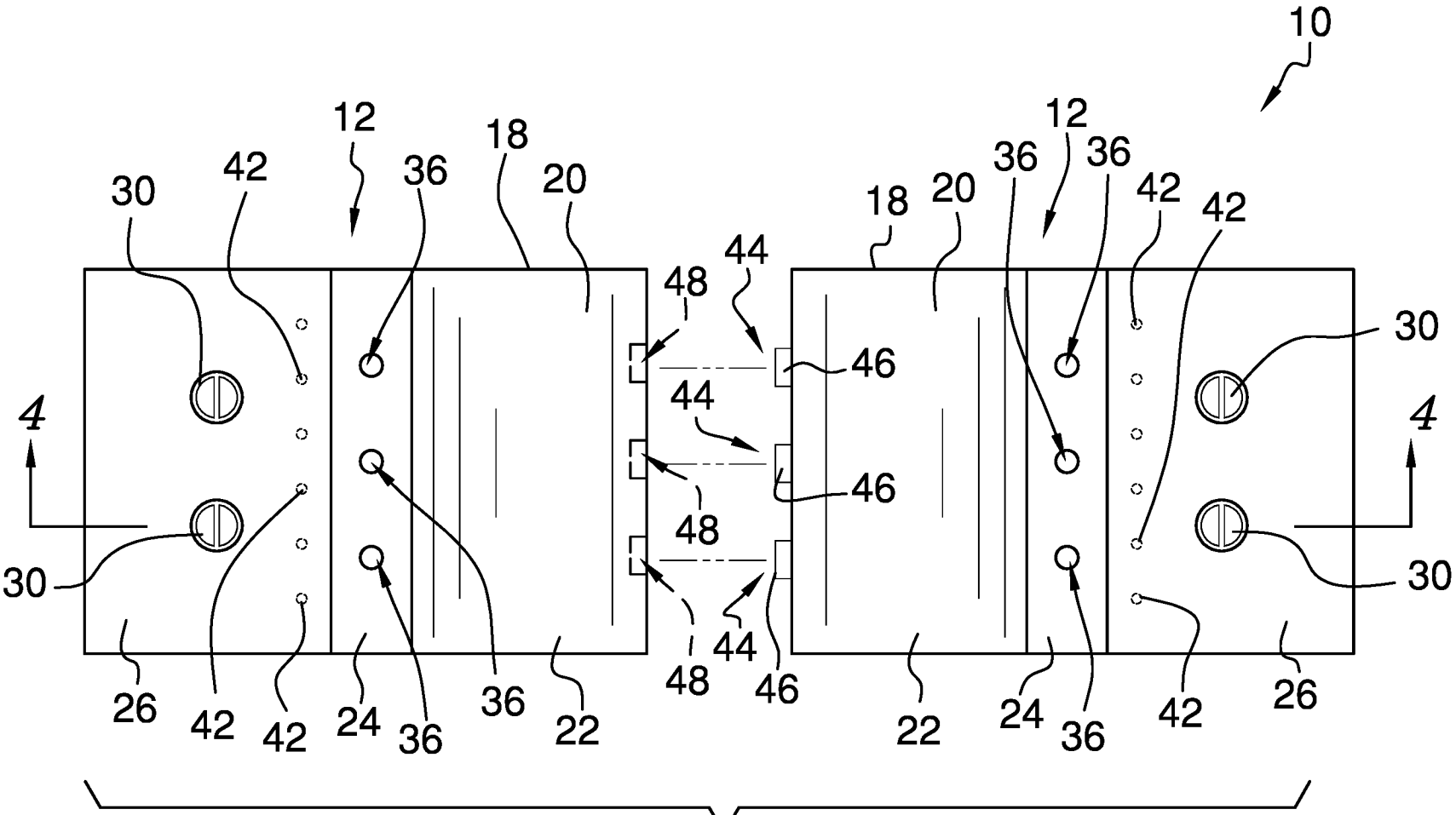
FIG. 2 is a top exploded view of an embodiment of the disclosure.
Figure 3:
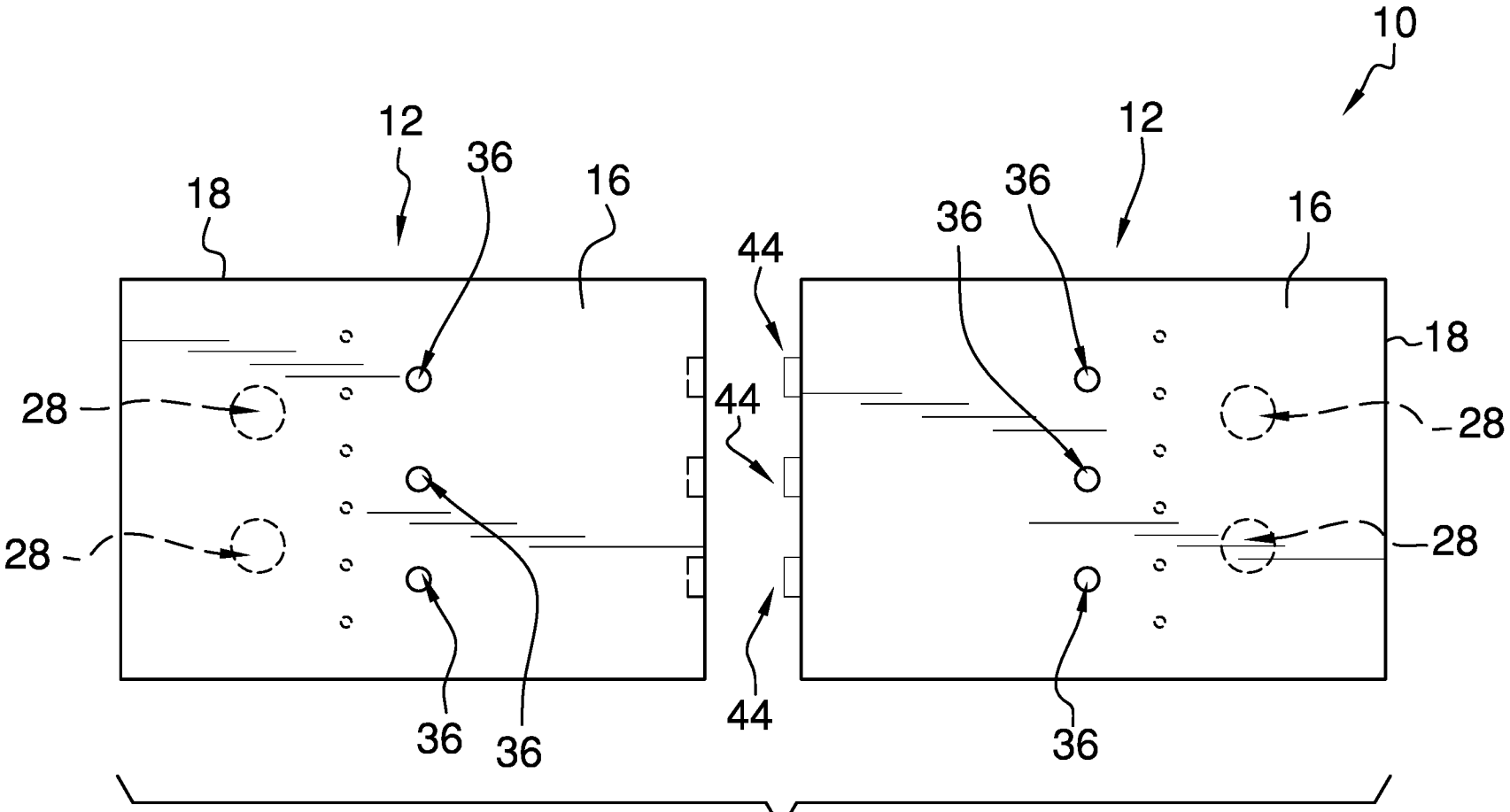
FIG. 3 is a bottom exploded view of an embodiment of the disclosure.
Figure 4:
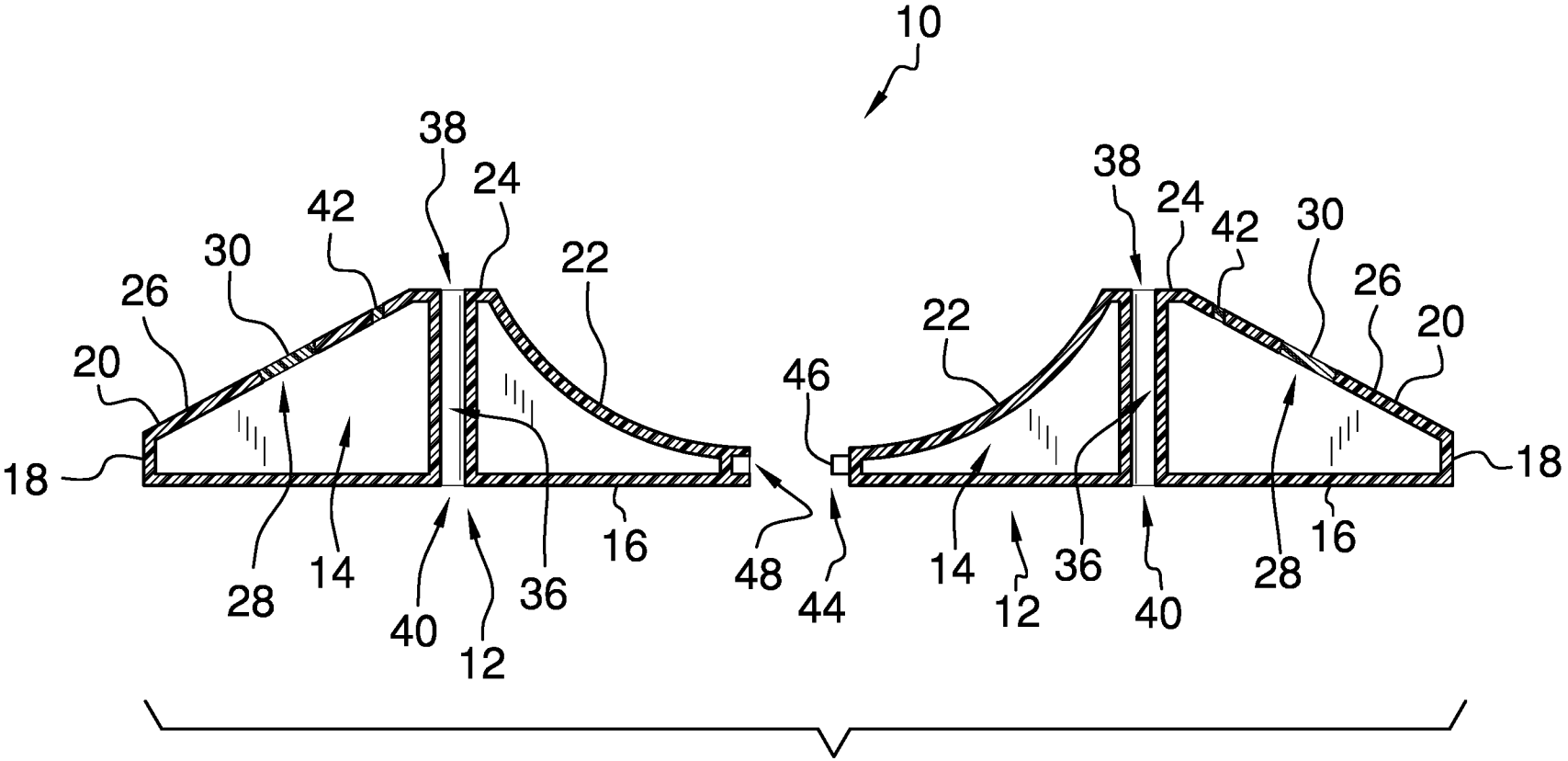
FIG. 4 is a cross section view of an embodiment of the disclosure taken from Arrows 4-4 in FIG. 2.
Figure 5:
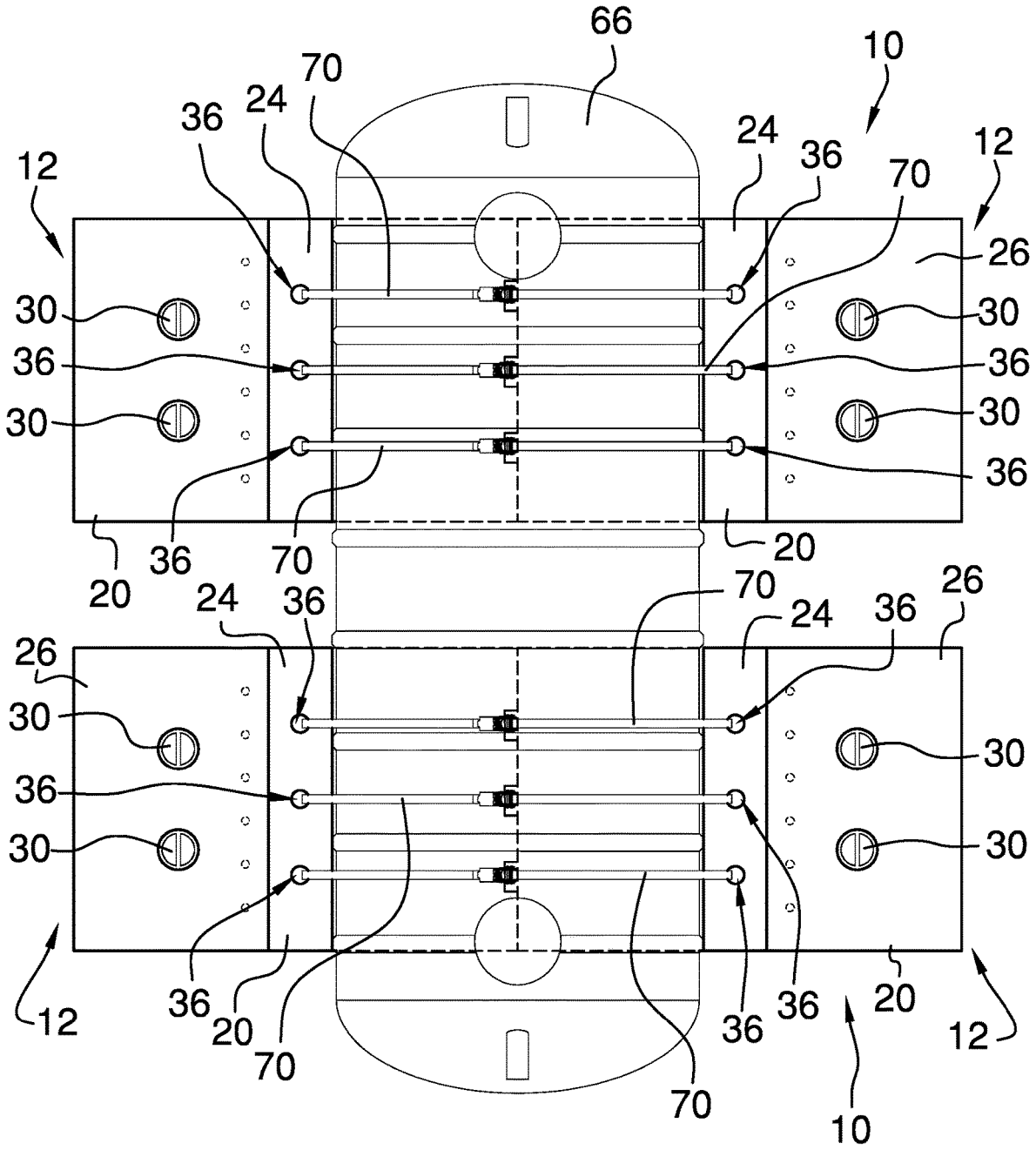
FIG. 5 is a top in-use view of an embodiment of the disclosure.
Figure 6:
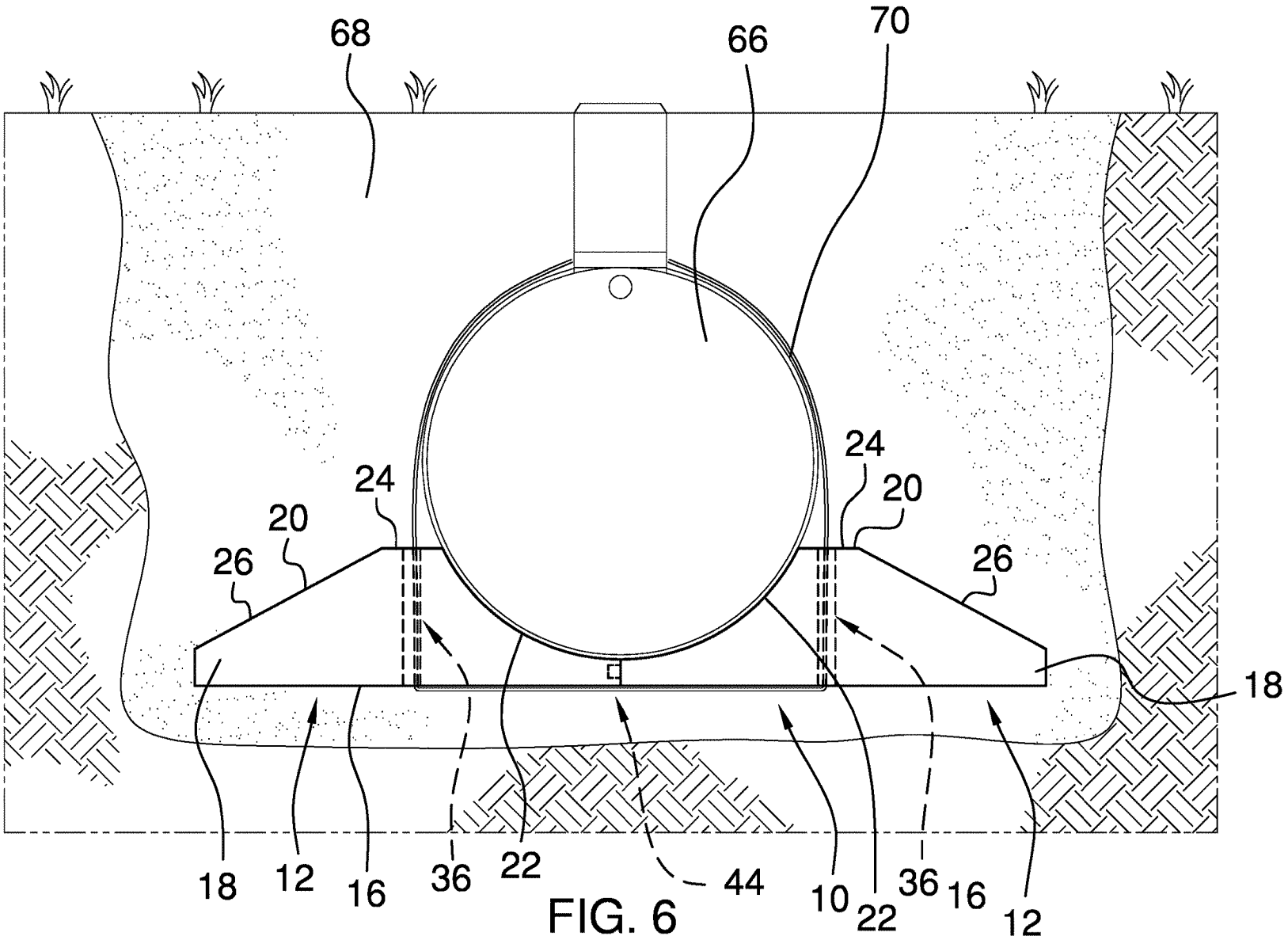
FIG. 6 is a front in-use view of an embodiment of the disclosure.

With reference now to the drawings, and in particular to FIGS. 1 through 7 thereof, a new anchoring apparatus embodying the principles and concepts of an embodiment of the disclosure and generally designated by the reference numeral 10 will be described.

As best illustrated in FIGS. 1 through 6, the anchoring apparatus 10 generally comprises a pair of bases 12. Each base 12 of the pair of bases 12 comprises a container 14 which defines an interior space 16. The container 14 has a bottom wall 16, a perimeter wall 18, and a top wall 20. The perimeter wall 18 is coupled to and extends between the bottom wall 16 and the top wall 20. The top wall 20 has a support portion 22 which is configured to support a load 66. The load 66 typically contains an interior space (not shown) which causes the load to be buoyant in water, especially if emptied completely of any contents. The load 66 may be, for example, a septic tank, a holding tank, or a casket. However, any load which is buoyant in water may be anchored in soil 68 by the anchoring apparatus 10, and the anchoring apparatus 10 may be used to anchor the load 66 in soil 68 against any upward force applied to the load 66.

The support portion 22 is concave and slopes downwardly toward the perimeter wall 18. The pair of bases 12 are positionable such that the support portions 22 of the bases 12 are positionable adjacent to each other, forming a U-shape.

In other embodiments, the support portions 22 may have different shapes from that shown in the drawings and which are adapted to conform to a shape of the load 66. In some embodiments, the pair of bases 12 are integrally formed, and the interior spaces 16 of the bases 12 may be in fluid communication with each other in such embodiments.

The top wall 20 of each base 12 of the pair of bases 12 further has an outer portion 26 and a medial portion 24. The medial portion 24 is coupled to and extends between the outer portion 26 and the support portion 22. The outer portion 26 is angled downwardly from the medial portion 24 to the perimeter wall 18 and defines a pair of fill holes 28. The pair of fill holes 28 are in fluid communication with the interior space 16. Each one of a pair of caps 30 is removably attachable to the container 14 to close an associated fill hole 28 of the pair of fill holes 28. External threads 32 of each cap 30 of the pair of caps 30 are complementary in shape to internal threads 34 of the associated fill hole 28. In other embodiments, the caps 30 may attach to the container 14 via latches, snap connections, friction fits, or the like.

A plurality of tubes 36 extends through the container 14. Each tube 36 of the plurality of tubes 36 has an open upper end 38 and an open lower end 40 and extends through the bottom wall 16 and the top wall 20 of the container 14. A plurality of knockout plugs 42 is mounted to the top wall 20 of the container 14. Each knockout plug 42 of the plurality of knockout plugs 42 is removable to form a drain hole in the top wall 20. A plurality of connectors 44 is coupled to each base 12 of the pair of bases 12. The plurality of connectors 44 is operable to releasably couple the pair of bases 12 together such that the support surfaces of the pair of bases 12 are positioned adjacent to each other. Each connector 44 of the plurality of connectors 44 comprises an insertion member 46 and a receiver 48. In other embodiments, the connectors 44 comprise latches, threaded fasteners, snap connections, or the like.

In use, the pair of bases 12 are connected via the plurality of connectors 44 underneath the load 66 to support the load 66. Mounting straps 70 are inserted through the tubes 36 and around the load 66 to attach the pair of bases 12 to the load 66. The bases 12 also may be attached to the load 66 via weldments, threaded fasteners, latches, or the like. Water, sand, rocks, or other weights are added into the interior spaces 16 via the fill holes 28. If desired, the knockout plugs 42 are removed to allow drain water to enter the interior spaces 16 via the openings produced by removing the knockout plugs 42. When an upward force acts on the load 66, such as a buoyant force caused during flooding, the weights counteract the upward force to secure the load 66 against the upward forces. The medial portions 24 and outer portions 26 of the bases 12 also push against soil 68 placed on the bases 12 to secure the load 66 against the upward forces.

Figure 7:
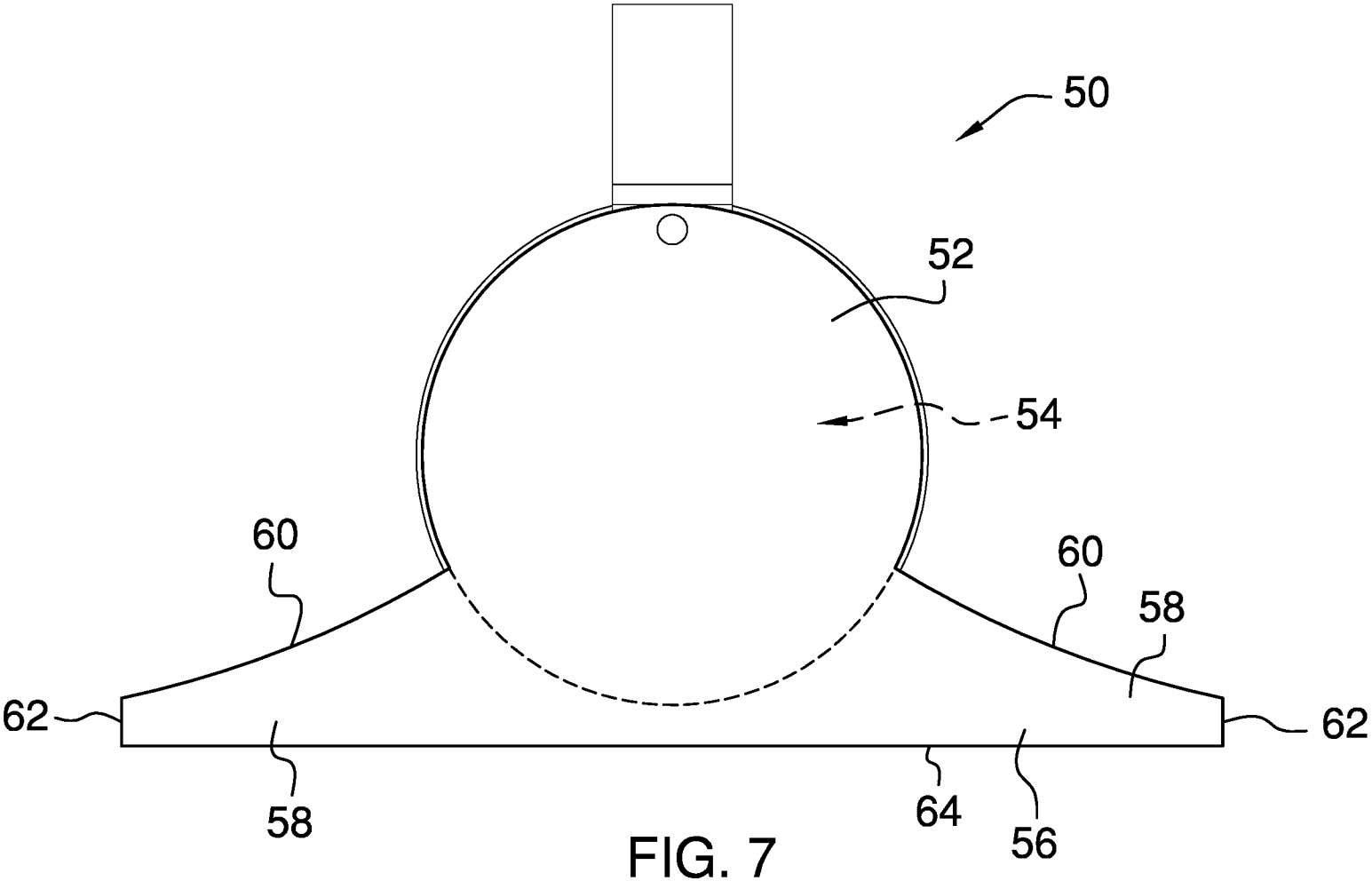
FIG. 7 is a front view of an embodiment of the disclosure.

With reference to FIG. 7, another embodiment of the invention includes a buried container apparatus 50 comprising a vessel 52 which defines an interior volume 54 and a vessel support 56 coupled to the bottom of the vessel 52. The vessel 52 and the vessel support 56 may be integrally formed with each other. The vessel support 56 has a pair of segments 58 which extend away from each other past the vessel 52. Each segment 58 of the pair of segments 58 has an upper surface 60 which is configured for inhibiting an upward movement of the vessel 52 when urged against soil 68 placed over the upper surfaces 60. The upper surface 60 of each segment 58 slopes downwardly from the vessel 52 to a free end 62 of the segment 58 and is concavely arcuate. The vessel support 56 has a weight wherein the vessel support 56 is configured to inhibit upward movement of the vessel 52.

In some embodiments, the vessel support 56 may be hollow, allowing for weights such as water, rocks, sand, or the like to be added to the vessel support 56. A bottom surface 64 of the vessel support 56 may also define a cavity such that an upward force applied to the vessel support 56 would result in a resultant suction force against the bottom surface 64 of the vessel 52. The resultant suction force would act on the vessel support 56 to secure the vessel support 56 against the upward force.

The buried container apparatus 50 is used to store material below a ground surface. For example, the buried container apparatus 50 may be used as a septic tank, a holding tank, a casket, or the like. The vessel support 56 serves to retain the buried container apparatus 50 against upward forces exerted on the buried container apparatus 50, such as buoyant forces experienced during flooding. The vessel support 56 reacts to upward forces via weight, a normal force against soil 68 positioned above the upper surfaces 60 of the pair of segments 58 of the vessel support 56, and via the suction force described.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An anchoring apparatus comprising:

a pair of bases, each base of the pair of bases comprising a container, the container defining an interior space, the container having a bottom wall, a perimeter wall, and a top wall, the perimeter wall being coupled to and extending between the bottom wall and the top wall, the top wall having a support portion which is configured to support a load, the top wall further having an outer portion and a medial portion, the medial portion being coupled to and extending between the outer portion and the support portion, the outer portion defining a fill hole, the fill hole being in fluid communication with the interior space, the pair of bases being positionable with respect to each other such that the support portions of the bases are positioned adjacent to each other; and wherein the support portion of each base of the pair of bases is concave, the support portion sloping downwardly toward the perimeter wall.

2. The apparatus of claim 1, wherein the outer portion of each base of the pair of bases is angled downwardly from the medial portion to the perimeter wall.

3. The apparatus of claim 1, wherein each base of the pair of bases further comprises a cap, the cap being removably attachable to the container to close the fill hole.

4. The apparatus of claim 3, wherein external threads of the cap are complementary in shape to internal threads of the fill tube.

5. The apparatus of claim 1, wherein each base of the pair of bases further comprises a plurality of knockout plugs being mounted to the top wall of the container, each knockout plug of the plurality of knockout plugs being removable to form a drain hole in the top wall.

6. The apparatus of claim 1, further comprising a plurality of connectors being coupled to each base of the pair of bases, the plurality of connectors being operable to releasably couple the pair of bases together such that the support surfaces of the pair of bases are positioned adjacent to each other.

7. The apparatus of claim 6, wherein each connector of the plurality of connectors comprises an insertion member 46 and a receiver 48.

8. An anchoring apparatus comprising:

a pair of bases, each base of the pair of bases comprising a container, the container defining an interior space, the container having a bottom wall, a perimeter wall, and a top wall, the perimeter wall being coupled to and extending between the bottom wall and the top wall, the top wall having a support portion which is configured to support a load, the top wall further having an outer portion and a medial portion, the medial portion being coupled to and extending between the outer portion and the support portion, the outer portion defining a fill hole, the fill hole being in fluid communication with the interior space, the pair of bases being positionable with respect to each other such that the support portions of the bases are positioned adjacent to each other; and wherein each base of the pair of bases further comprises a plurality of tubes extending through the container, each tube of the plurality of tubes having an open upper end and an open lower end, each tube of the plurality of tubes extending through the bottom wall and the top wall of the container, each tube of the plurality of tubes being configured to receive a mounting strap.

9. An anchoring apparatus comprising:

a pair of bases, each base of the pair of bases comprising:

a container, the container defining an interior space, the container having a bottom wall, a perimeter wall, and a top wall, the perimeter wall being coupled to and extending between the bottom wall and the top wall, the top wall having a support portion which is configured to support a load, the support portion being concave, the support portion sloping downwardly toward the perimeter wall, the top wall further having an outer portion and a medial portion, the medial portion being coupled to and extending between the outer portion and the support portion, the outer portion being angled downwardly from the medial portion to the perimeter wall, the outer portion defining a pair of fill holes, the pair of fill holes being in fluid communication with the interior space;

a plurality of tubes extending through the container, each tube of the plurality of tubes having an open upper end and an open lower end, each tube of the plurality of tubes extending through the bottom wall and the top wall of the container, each tube of the plurality of tubes being configured to receive a mounting strap;

a pair of caps, each cap of the pair of caps being removably attachable to the container to close an associated fill hole of the pair of fill holes, external threads of each cap of the pair of caps being complementary in shape to internal threads of the associated fill hole; and a plurality of knockout plugs being mounted to the top wall of the container, each knockout plug of the plurality of knockout plugs being removable to form a drain hole in the top wall; and a plurality of connectors being coupled to each base of the pair of bases, the plurality of connectors being operable to releasably couple the pair of bases together such that the support surfaces of the pair of bases are positioned adjacent to each other, each connector of the plurality of connectors comprising an insertion member 46 and a receiver 48.

* * * * *